US005850170A

United States Patent [19]

Kern

[11] Patent Number: 5,850,170

[45] Date of Patent: Dec. 15, 1998

[54] ELECTROMAGNETIC DIFFERENTIAL CURRENT TRIGGER

[75] Inventor: Josef Kern, Berlin, Germany

[73] Assignee: Siemens Aktiengesellschaft, Munich, Germany

[21] Appl. No.: 966,692

[22] Filed: Nov. 10, 1997

[30] Foreign Application Priority Data

Nov. 7, 1989 [DE] Germany ..... 196 46 243.6

[51] Int. Cl.[6] ..... H01F 7/00

[52] U.S. Cl. ..... 335/229; 335/251

[58] Field of Search ..... 335/167–176, 335/177, 178, 179, 78–86, 124, 128, 251, 272, 281, 282

[56] References Cited

U.S. PATENT DOCUMENTS 2,919,324 12/1959 Schuessler ..... 335/280
3,117,257 1/1964 Stone ..... 335/177
5,453,724 9/1995 Seymour et al. ..... 335/172

FOREIGN PATENT DOCUMENTS 0 377 479 7/1990 European Pat. Off. .
0 643 872 3/1995 European Pat. Off. .

*Primary Examiner*—Lincoln Donovan
*Attorney, Agent, or Firm*—Hill & Simpson

[57] ABSTRACT

An electromagnetic differential current trigger is provided which includes a coil with a U-shaped yoke. A permanent-magnetic armature is guided axially inside the coil that retains the armature against a yoke leg opposing the force of a compression spring in the idle position, whereas a compression spring actuates a power switch via an actuation element given triggering by a differential current in the coil. The differential current trigger requires few parts and can be magnetically balanced in a fast and efficient manner.

19 Claims, 4 Drawing Sheets

ELECTROMAGNETIC DIFFERENTIAL CURRENT TRIGGER

BACKGROUND OF THE INVENTION

FIELD OF THE INVENTION

The present invention relates to differential current triggers and, more specifically, to electromagnetic differential current triggers.

A bistable electromagnet is known from the EP-A1-0 643 872 which is formed as a solenoid valve. In EP-A1-0 643 872, a ferromagnetic cylindrical armature is arranged inside the coil that actuates a valve with its end protruding from the coil. In addition to the armature, a fixed core is provided therein in one end section of the coil interior that contains a movable permanent magnet in a cavity in addition to the armature. The end section of the armature that faces away from the core is surrounded by an additional pole tube. As a result, this known bistable electromagnet possesses a relatively large number of individual parts that not only need space, but also more expensive to manufacture and assemble.

SUMMARY OF THE INVENTION

In an embodiment, the invention provides an electromagnetic differential current trigger with a coil; a U-shaped yoke that covers the first end face of the coil with a first yoke leg and the second face end of the coil with the second yoke leg whereby the second yoke leg comprises an aperture or bore that is coaxial to the coil; and an armature that is arranged inside the coil that is axially movable and is conducted through the aperture of the second yoke leg. The armature is kept in an idle position at the first yoke leg by the force of a permanent magnet opposing the force of a spring and that, after the triggering via a coil current, is pulled by the spring force into a triggering position lifted off from the first yoke leg.

It is a goal of the invention to create a differential current trigger of the type mentioned above that possesses optimally few individual parts and, therefore, can be produced inexpensively. This trigger should, nevertheless, possess a high responsiveness that can be set very exactly without additional mechanical adjustment work.

This goal is achieved in the present invention in that the armature itself is, at least partially fashioned as a permanent magnet and holds itself in the idle position at the first yoke leg.

The need for an additional permanent magnet is, first of all, eliminated by the permanent-magnet provided by the armature that is movable inside the coil tube in an axial direction; one receives a largely symmetric, easily duplicated magnetic circle that closes itself over the soft magnetic, U-shaped yoke. A coil body that carries the coil can simultaneously serve as guide for the permanent-magnetic armature, whereby a ring-shaped projection of the coil body can be inserted into the clearance between the second yoke leg and the coil as well as clearance between the second yoke leg and the armature. At least one of the pole areas of either armature or of the first yoke leg is formed slightly convexly in order to concentrate the magnetic flux in the middle. The first yoke leg is preferably coined inwardly crowned for this purpose. The armature end that is guided towards the second yoke leg actuates a switch element via an extension, preferably a power switch. Such an actuation element can preferably be connected to the armature via plastic injection or in a comparable connection technique. A resetting lever is expediently connected with this actuation element preferably of one piece. This resetting lever, which protrudes outward through a housing in one embodiment works simultaneously as indication element for the position of the trigger. An additional microswitch that is arranged in the housing can be actuated via a further actuation arm.

In an embodiment, the spring power for prestressing the armature into its trigger position is produced by a compression spring that is guided outside the coil in a ring-shaped channel of the actuation element and is supported at the second yoke leg. Thus, it does not use any space in the magnetically effective space inside the coil.

The setting of the responsiveness of the trigger of the invention can be undertaken in a simple way after the assembly by applying an external magnetic field to the armature, whereby the tolerance of the actuation current of the coil is accurately adjusted by weakening or strengthening, respectively, the permanent magnetic armature. Therefore, no additional mechanical adjustments are necessary. In another embodiment of the invention, it can also be provided in order to additionally influence the response characteristic of the trigger that the armature is formed as a permanent magnet only over a part of its axial length while the other part, preferably the one that is next to the first yoke leg, is ferromagnetic. Thereby, the force/path curve, for example, can be modified in such a way that an additional force component is applied in the end area of the actuation movement for the through-connection of a power switch.

In an embodiment, the electromagnetic differential current trigger of the present invention includes a cylindrical coil having a first end, a second and a central opened area extending axially therebetween. The first end of the coil is covered by a first yoke leg of a U-shaped yoke and the second end of the coil is covered by a second yoke leg of the U-shaped yoke. The second yoke leg includes a bore or aperture that is in axial alignment with the central opening of the coil. The coil accommodates an armature in the central open area, one end of the armature being disposed adjacent to the first yoke leg and a second end extending partially through the bore in the second yoke leg. The armature includes a permanent magnet portion that is disposed adjacent to the first yoke leg which biases the armature toward an idle position whereby one end of the armature engages the first yoke leg. A spring biases the armature in an opposite direction, or towards the second yoke leg. However, the bias of the spring is successfully opposed by the bias created by the permanent magnet portion of the armature and the first yoke leg unless current is passed through the coil. When current is passed through the coil, the resulting magnetic force and the bias of the spring overcomes the bias imposed by the permanent magnet portion of the armature and the first yoke leg thereby causing the armature to extend farther through the aperture in the second yoke leg towards a triggering position.

In an embodiment, a clearance is provided between the armature and the second yoke leg.

In an embodiment, the coil is wrapped around a coil body which provides a central lining for centering the armature and guiding the armature through the bore in the second yoke leg.

In an embodiment, the end of the armature that engages the first yoke leg in the idle position is curved concavely away from the first yoke leg and, the portion of the first yoke leg that engages the end of the armature is curved convexly towards the armature.

In an embodiment, the armature is connected to an actuation element that includes a collar with a channel for accommodating the spring, the spring being disposed between the channel of the collar and the second yoke leg.

In an embodiment, the actuation element is fabricated from a plastic material and is molded onto the armature.

In an embodiment, the armature includes a ferromagnetic portion in addition to the permanent magnet portion. The permanent magnet portion being disposed towards the end of the armature directed toward the first yoke leg and the ferromagnetic portion being disposed in the end of the armature directed toward the second yoke leg.

In an embodiment, the actuation element further includes a thin-walled sleeve that extends down the armature and connects both the ferromagnetic and permanent magnet portions of the armature to the actuation element.

Other objects and advantages of the present invention will become apparent upon reading the following detailed description and appended claims and upon reference to the accompanying drawing.

BRIEF DESCRIPTION OF THE DRAWING

For a more complete understanding of the present invention, reference should now be made to the embodiments illustrated in greater detail in the accompanying drawing and described below by way of examples of the present invention.

In the drawing.

Figure 1:
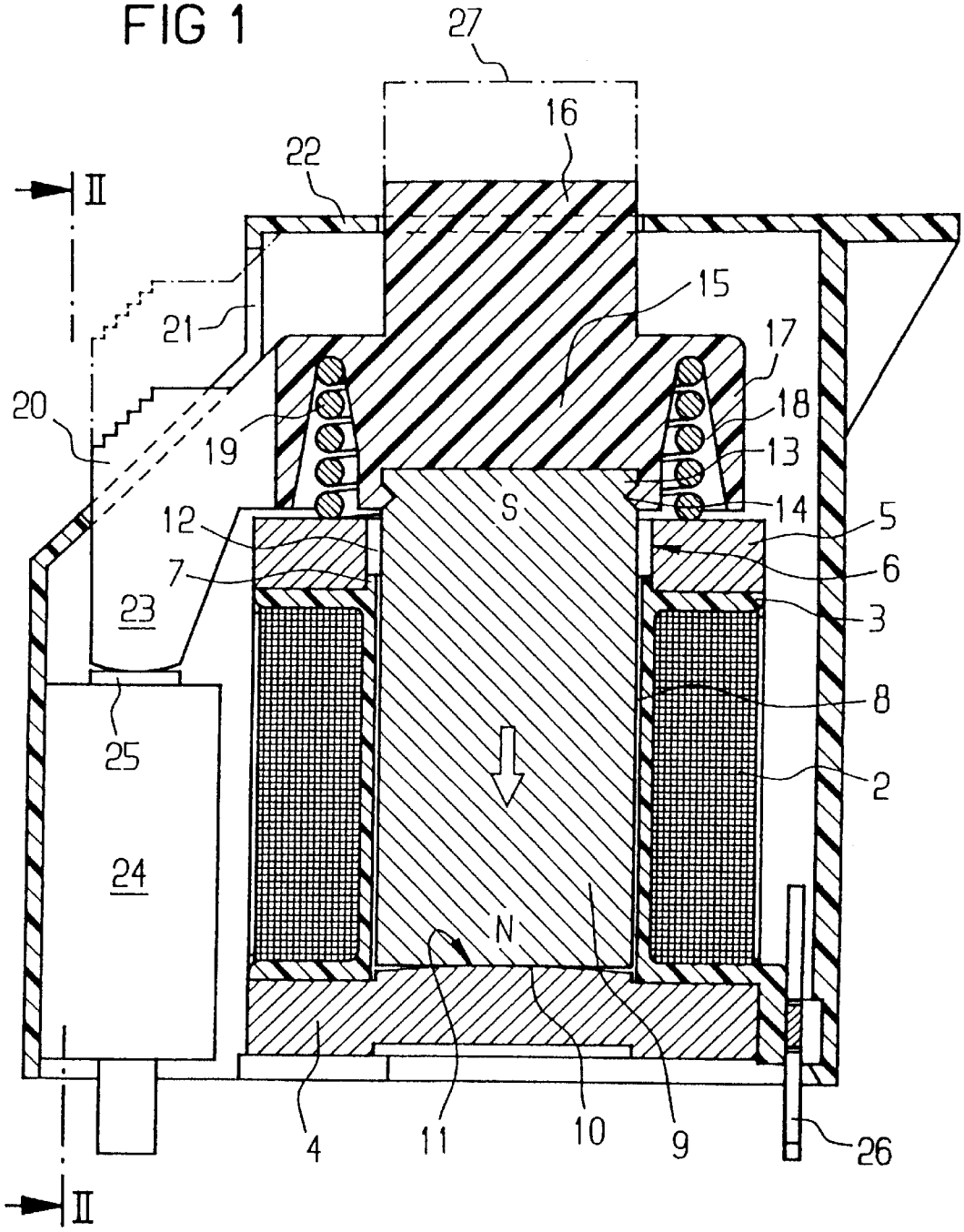
FIG. 1 is a sectional view taken substantially along line I—I of FIG. 2 and particularly illustrating a differential current trigger of the present invention in a sectional view along the coil axis.

It should be understood that the drawing is not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 2:
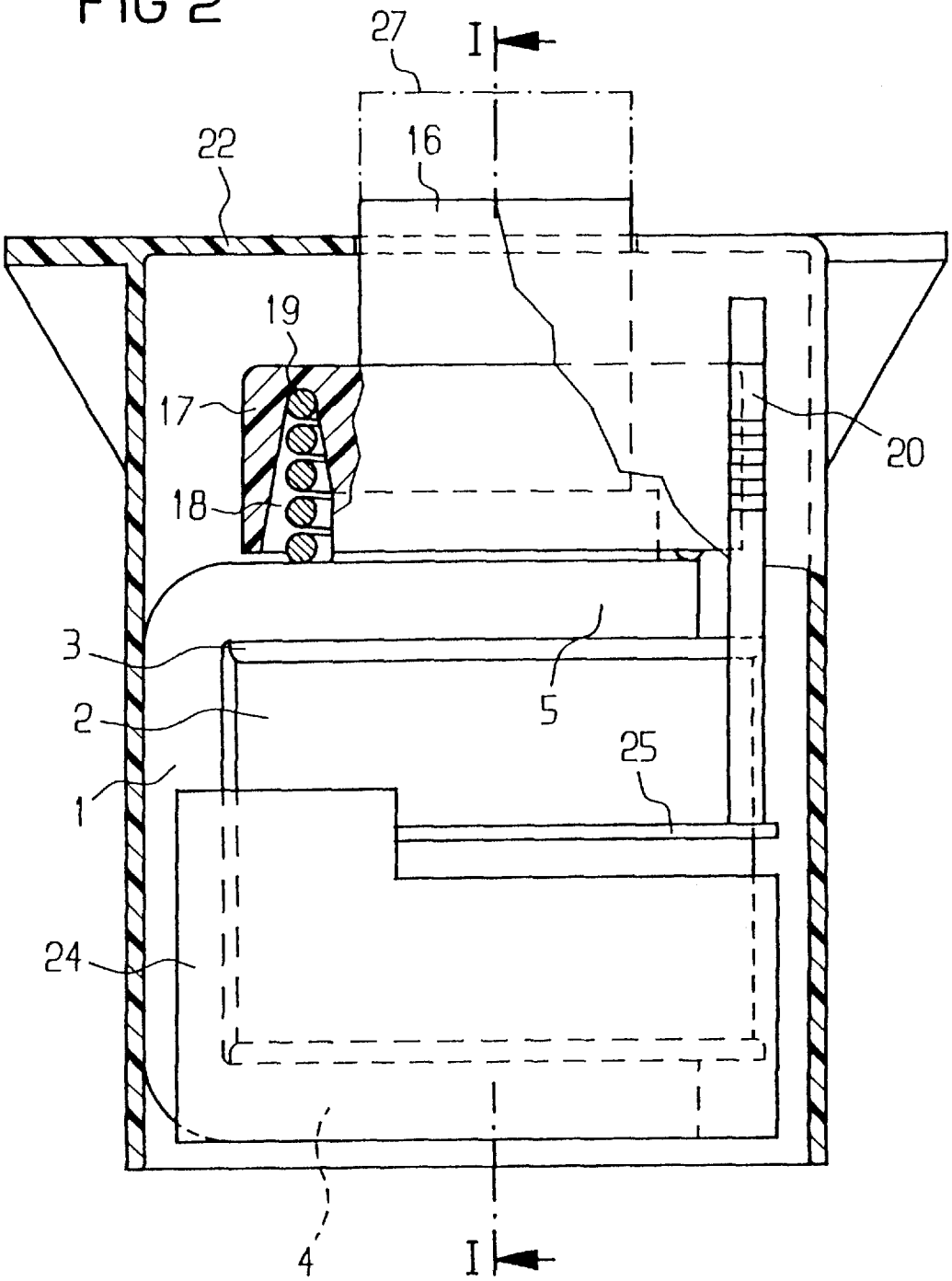
FIG. 2 is a sectional view taken substantially along line II—II of FIG. 1 and more particularly a partial view of the trigger of FIG. 1 turned by 90°.

The differential current trigger shown in FIGS. 1 and 2 in two views possesses a magnetic system with a one-part, U-shaped yoke 1 that encloses a coil 2 with a coil body 3. Thereby, a first yoke leg 4 covers the first face side of the coil depicted as the lower end of FIGS. 1 and 2, whereas a second yoke leg 5 extends transversely across the second face side of the coil, depicted at the upper end of FIGS. 1 and 2. This second yoke leg 5 possesses a central clearance or aperture 6 wherein the coil body 3 is centered with a ring-shaped projection 7. An axial through opening 8 of the coil or the coil body 3, respectively, is thus aligned with the clearance 6. A cylindrical permanent-magnet core as armature 9 is movably guided in it in axial direction. The first yoke leg 4 is coined crowned as pole area for flux concentration in its middle area 10 that faces towards the armature 9. As a result of the axial magnetization of the permanent-magnetic armature 9, this exerts the holding force to the pole area 10 of the yoke 1 via its end face 11. The magnetic return ensues over the three sections of the yoke 1 and over the ring-shaped, small air gap 12 in the yoke bore 6 onto the other pole side of the armature.

The end 13 of the armature 9 that is guided through the yoke leg 5 comprises notches 14, whereby an actuation element 15 which is formed by extrusion of the armature end is firmly connected with the armature. This actuation element is integrally formed from thermo- or thermosetting plastic and possesses different functions:

A tappet 16 is attached as extension in axial direction and serves in order to trigger a power switch that is not shown.

An all around plate-shaped collar 17 possesses a channel 18. This channel 18 serves as centering as well as abutment for a force storage in the form of a compression spring 19. This compression spring 19 supports itself on the second yoke leg 5 of the yoke 1 with its lower end around the core passage 6.

A resetting lever 20 that is attached on one side protrudes through a window 21 of a housing 22 that accepts the trigger and serves at the same time in order to optically recognize the switch status as well as in order to reset the trigger manually.

Another downwardly projecting actuation arm 23 of the resetting lever 20 additionally actuates a contact set in order to recognize the switch status electrically. This contact set is contained in a microswitch 24 in the example shown, the switching lever 23 of which is affected by the actuation arm 23. The actuation arm 23 is not in engagement with the microswitch in the triggering state, i.e., an idle contact provided in it is closed.

The function of the trigger of the invention derives from the structure described. The permanent-magnetic armature 9 is held at the yoke leg 4 by its own permanent magnet force via the pole area 10 in the idle condition. Thereby, the force of the permanent-magnetic armature 9 overcomes the spring force of the compression spring 19. Thereby, the coil 2 that is switched with its contacts 26 into a circuit to be monitored is first without power. If a fault current, however, occurs in the network, the coil 2 is excited and it produces a magnetic counterflux to the flux of the permanent magnet of the armature 9. The holding force does not suffice any more due to the attenuation of the permanent magnet flux and the force storage in the form of the compression spring 19 pulls the triggering element 15 with the armature upwards away from the yoke leg 4, so that it actuates the power switch(not shown) via the tappet 16. The dotted line 27 indicates the triggering position of the tappet 16.

For a low-power triggering, the permanent magnet circuit dare have only a small force excess relative to the opposing force storage, i.e., of the compression spring 19. This force excess has to guarantee the resistance to vibration and shock and the function through the thermal influence (in different modes of application and at different operating temperatures). In order to compensate for the manufacturing tolerances (tolerances of the magnetic and coil circuit and the force storage), a magnetic alignment of the permanent-magnetic armature 9 ensues after the assembly of the quick trigger via a magnetic field applied from the outside. Thus, the tolerance of the triggering current of the coil 2 can be compensated in a small range by weakening or strengthening the permanent-magnetic armature.

Figure 4:
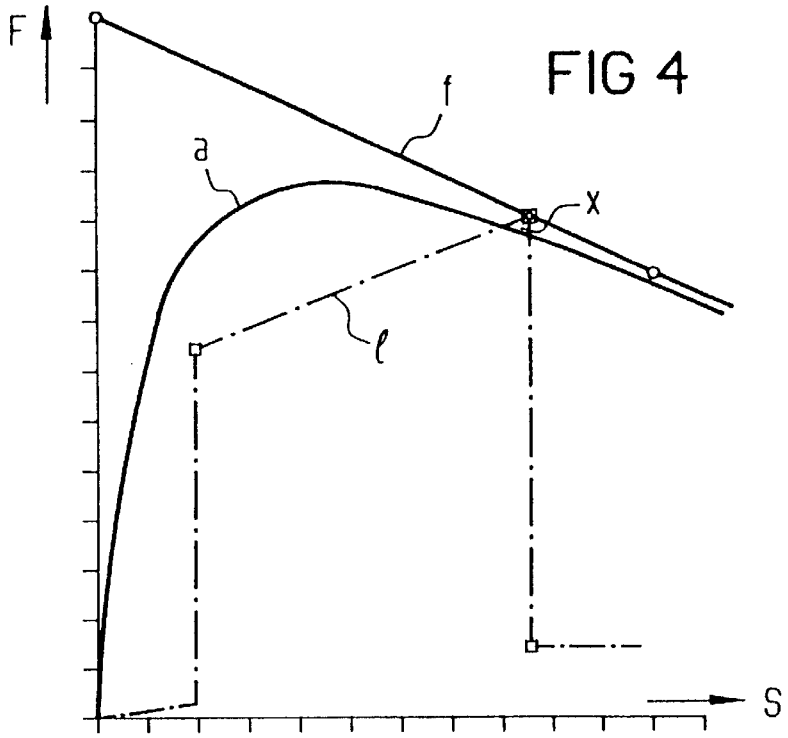
FIG. 4 illustrates graphically a force/path drawing for a triggering system according to FIG. 1.

FIG. 4 indicates a force/path characteristic of a triggering system according to FIG. 1. Therein, the force F is respectively entered over the path S that the armature 9 or the actuation element 15, respectively, traverses. In FIG. 4, the curve "f" shows the force/path course of the spring force of the compression spring 19, the curve "I" shows the course of a triggering characteristic of a power switch, whereas the curve "a" shows the available triggering force that results from the oppositely acting forces of the permanent-magnetic armature and the compression spring.

The compression spring 19 has a linear force/path characteristic f as shown in FIG. 4. This means, that the force for triggering becomes the smaller as the path S becomes larger. The force requirement thereof, however, normally needs (opposite to the force of the tappet) an ascending force curve for switching through. Given known quick triggers, this problem is solved, for example, by a tension spring with a lever translation subject to friction. Otherwise, there is the danger, as shown in FIG. 4, that the curve "a" falls in the final stage of the triggering movement below the curve "I" (area X) and the power switch can no longer connect under certain circumstances.

Figure 3:
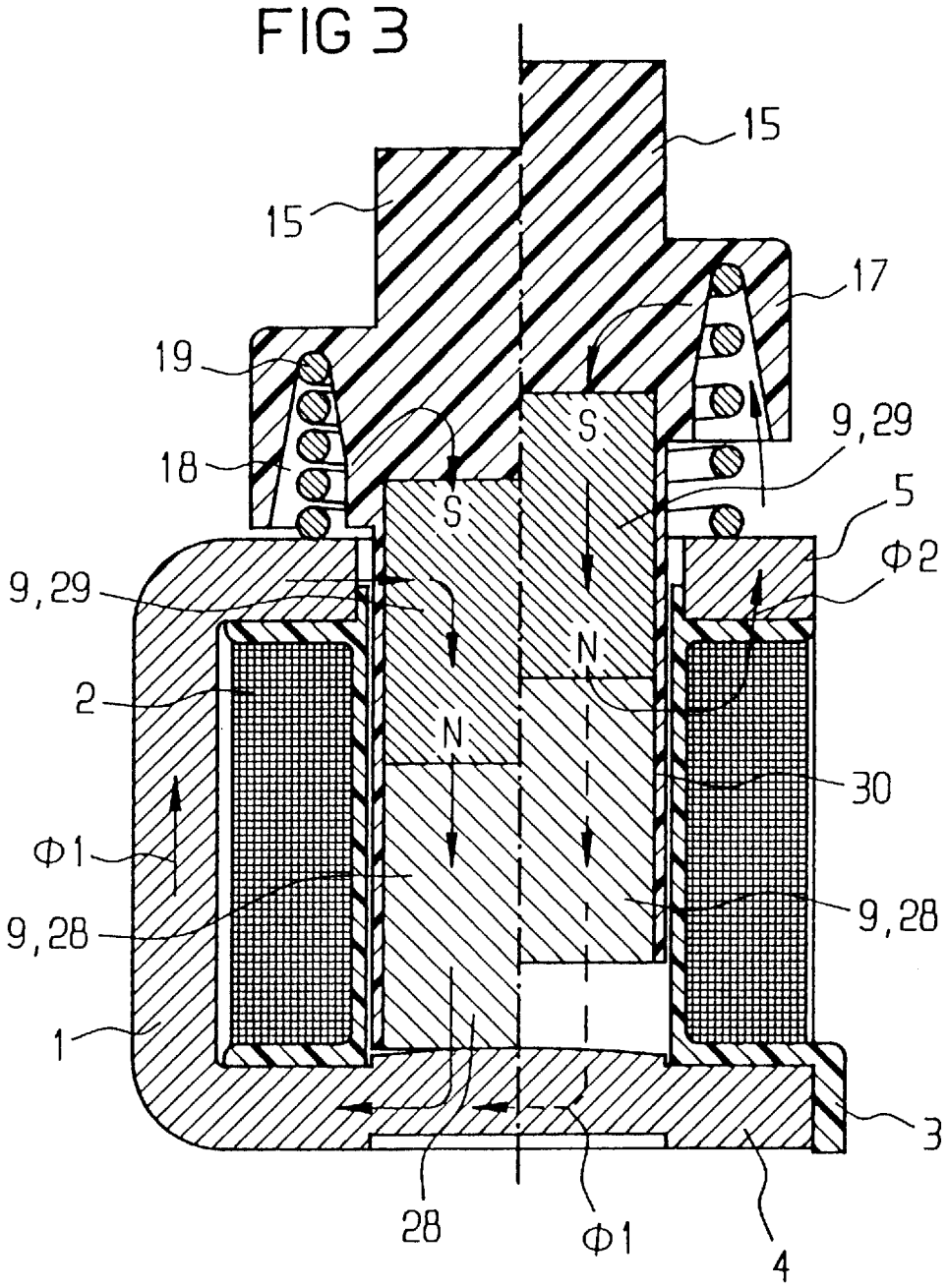
FIG. 3 is a sectional view of a slightly altered magnetic system, whereby the armature is shown partly in idle position, partly in triggering position.

In order to overcome this problem, the armature structure can be modified according to FIG. 3. In this case, the armature 9 is divided in its axial direction into a permanent-magnetic section 29 and a ferromagnetic section 28. The two cylinder sections 28 and 29 of the armature 9 are connected to a thin-wall sleeve 30 that is connected of one piece to the actuation element 15 by extrusion in the present example. The sectional view in FIG. 3 shows the left half of the armature 9 in idle position, whereas the right half is shown in the triggering position. Moreover, the trigger is built in the same way as in FIG. 1, so that a description of the remaining parts is not necessary.

In addition, the flowcourse of the permanent-magnetic flux is schematically indicated in FIG. 3. In the left part of FIG. 3, the flowcourse $\phi 1$ in the idle position is shown. Thereby, the permanent-magnetic flux of the permanent-magnetic sub-section 29 is closed in the idle position from north pole N via the ferromagnetic section 28 and the yoke 1 as well as the ring air gap 12 to the south pole S of the permanent-magnetic section 29. When the armature 9, however, is lifted off from the yoke leg 4 due to a triggering current impulse and is moved upwards by the compression spring 19 (see the right side of the armature 9 in FIG. 3), then only a part of the permanent-magnetic flux $\phi 1$ proceeds via the ferromagnetic section 28 and the yoke 1, whereas another part $\phi 2$ of the permanent magnetic flux of north pole N of the permanent-magnetic section 29 via the yoke leg 5 and, thereby, produces an additional force working in the direction of the trigger that adds an increasing permanent-magnetic force with an increasing path S of the tappet of the decreasing spring force of the compression spring 19.

Figure 5:
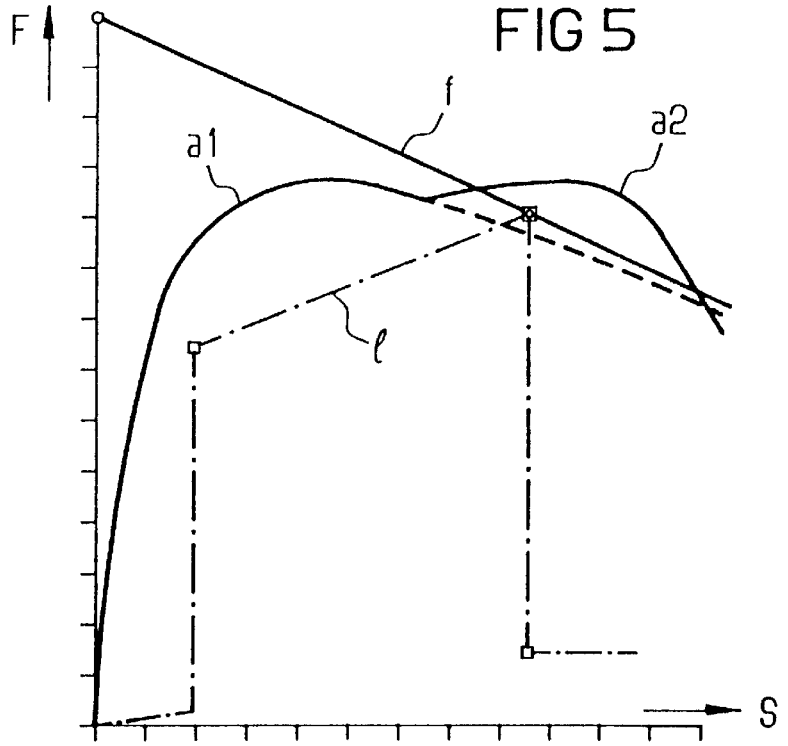
FIG. 5 illustrates graphically a force/path drawing for a triggering system according to FIG. 3.

The spring characteristic of an arrangement according to FIG. 3 is shown in FIG. 5. The curve "f" marks again as in FIG. 4 the force/path course of the compression spring 19, whereas the curve "I" marks the necessary actuation force of the power switch. The resulting force of the trigger follows in its first part "a1" the curve "a" of FIG. 4, whereas an intensification of the triggering force occurs in a second part "a2" due to the additional flux $\phi 2$, with which the force "I" of the power switch is overcome also in this area.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed:

1. An electromagnetic differential current trigger comprising:

a cylindrical coil comprising a first end, a second end with a central open area extending axially from the first end to the second end, the first end of the coil being covered by a first yoke leg of a U-shaped yoke and the second end of the coil being covered by a second yoke leg of the U-shaped yoke, the second yoke leg comprising a bore that is aligned coaxially with the central open area of the coil, the coil accommodating an armature in the central open area, at least a portion of the armature being axially movable through the bore of the second yoke leg, the armature comprising a closed magnetic circuit including a permanent magnet portion that biases the armature towards an idle position against the first yoke leg, the armature also being biased towards a triggering position away from the first yoke leg and at least partially through the bore of the second yoke leg by a spring, the bias of the spring being opposed and overcome by the bias of the permanent magnet portion of the armature in the absence of current passing through the coil, the armature being moved by the spring and a magnetic force generated by current passing through the coil into a triggering position so that at least part of the armature passes through the bore in the second yoke leg.

2. The trigger of claim 1 wherein a clearance is provided between the armature and the second yoke leg.

3. The trigger of claim 1 wherein the coil is wrapped around a coil body, the coil body comprising a central portion that guides the armature and centers an end of the armature in the bore of the second yoke leg thereby providing a clearance between the armature and the second yoke leg.

4. The trigger of claim 1 wherein the armature further comprises a first end disposed towards the first yoke leg and a second end disposed towards the second yoke leg, the first end of the armature being curved convexly towards the first yoke leg.

5. The trigger of claim 1 wherein the armature is connected to an actuation element, the actuation element comprising a collar with a channel for accommodating the spring, the spring being disposed between channel of the collar and the second yoke leg.

6. The trigger of claim 5 wherein the actuation element is fabricated from plastic that molded onto the armature.

7. The trigger of claim 5 wherein the actuation element engages a power switch when the trigger is in the triggering position.

8. The trigger of claim 5 wherein the actuation element further comprises an tappet that engages a power switch when the trigger is in the triggering position.

9. The trigger of claim 5 wherein that actuation element further comprises a resetting lever for facilitating a resetting of the trigger from the triggering position to the idle position.

10. The trigger of claim 5 where the actuation element further comprises an actuation arm that engages a switch.

11. The trigger of claim 5 wherein the actuation element further comprises a thin-walled sleeve that connects both the ferromagnetic and permanent magnet portions of the armature to the actuation element.

12. The trigger of claim 1 wherein the armature comprises a ferromagnetic portion disposed between the second yoke leg and the permanent magnet portion.

13. An electromagnetic differential current trigger comprising:

a coil wrapped around a cylindrical coil body, the coil body comprising a first end, a second end with a cental open area extending axially from the first end to the second end, the first end of the coil body being covered by a first yoke leg of a U-shaped yoke and the second end of the coil body being covered by a second yoke leg of the U-shaped yoke, the second yoke leg comprising a bore that is aligned coaxially with the central open area of the coil body, the coil body accommodating and centralizing an armature in the central open area, the armature comprising a first end disposed adjacent to the first yoke leg and a second end located adjacent to the second yoke leg, at least a portion of the second end of the armature being axially movable through the bore of the second yoke leg with a clearance being provided between the second yoke leg and the armature, the armature further comprising a closed magnetic circuit wherein the first end of the armature further comprising a permanent magnet portion that biases the armature towards an idle position against the first yoke leg and the second end of the armature comprising a ferromagnetic portion, the armature also being biased towards a triggering position away from the first yoke leg and at least partially through the bore of the second yoke leg by a spring, the second end of the armature being connected to an actuation element, the actuation element comprising a collar, the spring being disposed between the collar and the second yoke leg, the bias of the spring being opposed and overcome by the bias of the permanent magnet portion of the armature in the absence of current passing through the coil, the armature is moved into a triggering position by the bias of the spring and a magnetic force generated by current passing through the coil so that at least part of the second end of the armature moves through the bore in the second yoke leg and the first end of the armature moves away from the first yoke leg.

14. The trigger of claim 13 wherein the first end of the armature is curved convexly towards the first yoke leg.

15. The trigger of claim 13 wherein the collar comprises a channel for accommodating the spring, the spring being disposed between channel of the collar and the second yoke leg.

16. The trigger of claim 13 wherein the actuation element is fabricated from plastic that molded onto the armature.

17. The trigger of claim 13 wherein the actuation element further comprises a thin-walled sleeve that connects both the ferromagnetic and permanent magnet portions of the armature to the actuation element.

18. An electromagnetic differential current trigger comprising:

a U-shaped yoke that comprises a first leg and a second leg with a coil disposed therebetween, the coil comprising a central open area that accommodates an armature, the second yoke leg comprising a bore that is in axial alignment with the armature and the central open area of the coil, at least a portion of the armature being axially movable through the bore, the armature comprising a closed magnetic circuit including a permanent magnet portion that biases the armature towards the first yoke leg in an idle position, the armature also being biased towards a triggering position away from the first yoke leg and at least partially through the bore of the second yoke leg by a spring, the bias of the spring being opposed and overcome by the bias of the permanent magnet portion of the armature in the absence of current passing through the coil, the bias of the permanent magnet being overcome by the spring and a magnetic force generated when current passes through the coil which results in the armature being moved at least partially through the bore in the second yoke leg and away from the first yoke leg and into a triggering position.

19. The trigger of claim 1 wherein the armature further comprises a first end disposed towards the first yoke leg and a second end disposed towards the second yoke leg, the first yoke leg being curved convexly towards the first end of the armature.

* * * * *